US007243512B2

(12) United States Patent
Kim et al.

(10) Patent No.: US 7,243,512 B2
(45) Date of Patent: Jul. 17, 2007

(54) FILTER ASSEMBLY OF WASHING MACHINE

(75) Inventors: Keon Kim, Jinhae-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 134 days.

(21) Appl. No.: 10/717,668

(22) Filed: Nov. 21, 2003

(65) Prior Publication Data

US 2004/0104158 A1 Jun. 3, 2004

(30) Foreign Application Priority Data

Nov. 28, 2002 (KR) ..... 10-2002-0075001

(51) Int. Cl.
*D06F 39/10* (2006.01)

(52) U.S. Cl. ..... 68/18 F; 134/104.2; 134/104.4; 210/512.1

(58) Field of Classification Search ..... 68/18 F; 134/104.2, 104.4; 210/512.1, 787, 788
See application file for complete search history.

(56) References Cited

U.S. PATENT DOCUMENTS 2,439,535 A * 4/1948 Wilson ..... 210/407
2,959,286 A * 11/1960 Hickman ..... 210/138
3,466,901 A * 9/1969 Reid ..... 68/18 F
5,660,063 A * 8/1997 Lee et al. ..... 68/18 F
6,167,588 B1 * 1/2001 Dyson ..... 15/339
6,167,733 B1 * 1/2001 Lee ..... 68/18 F
6,752,920 B2 * 6/2004 Harris et al. ..... 210/107
6,938,627 B2 * 9/2005 Jung et al. ..... 134/104.2
2004/0129034 A1 * 7/2004 Zanello et al. ..... 68/18 F

* cited by examiner

*Primary Examiner*—Michael Barr
*Assistant Examiner*—Sarah E. Husband
(74) *Attorney, Agent, or Firm*—Ked & Associates, LLP

(57) ABSTRACT

A filter assembly for a washing machine is provided which uses a simple structure to separate dirt and/or particles from washing water using. The filter assembly includes a filter case with an inlet and an outlet each positioned along its circumference, and an opening within the filler case which allows for communication between the inlet and outlet. A filter is provided in the filter case, the filter having a plate disposed in front of the opening to prevent particles from passing through the opening. Rather, the heavy particles are gathered in a central area of the filter by a centrifugal force generated by the water flowing in the filter case.

47 Claims, 3 Drawing Sheets

FILTER ASSEMBLY OF WASHING MACHINE

This application claims the benefit of Korean Application(s) No. 10-2002-0075001 filed on Nov. 28, 2002, which is/are hereby incorporated by reference.

BACKGROUND OF THE INVENTION

1. Field of the Invention

The present invention relates to a washing machine, and more particularly, to a filter assembly of a washing machine having a simple structure to separate dirt or particles involved in washing water using a centrifugal force.

2. Discussion of the Related Art

Generally, a washing machine is an apparatus for removing contaminating particles attached to the laundry, e.g., clothes, linen, etc., using interaction between water and detergent.

Such a washing machine is categorized into an agitator type, a pulsator type and a drum type. The agitator type washing machine rotates a washing rod protruding upward from a bottom center of a tub clockwise and counterclockwise. The pulsator type washing machine performs a washing step using a frictional force between a current, which is generated from a disc type pulsator rotating on a bottom of a washing tub clockwise and counterclockwise, and the laundry. And, the drum type washing machine performs a washing step by putting the laundry, detergent, and water in a drum having a plurality of protruding tumbling ribs form its inner surface and by rotating the drum at a low rotational speed.

If the washing step is performed using one of the various type washing machines, the dirt or particles are separated from the laundry. Lots of particles are accordingly contained in the used water after completion of the washing step.

Meanwhile, the used water is generally discharged outside using a drain pump. In such a case, such particles as lint and the like are frequently fitted to an impeller of the drain pump or a motor shaft, whereby drain capacity of the washing machine is lowered, noise takes place, and the drain pump can be out of order.

SUMMARY OF THE INVENTION

Accordingly, the present invention is directed to a filter assembly of a washing machine that substantially obviates one or more of the problems due to limitations and disadvantages of the related art.

An object of the present invention, which has been devised to solve the foregoing problem, lies in providing a filter assembly of a washing machine, by which dirt or particles involved in washing water can be removed.

It is another object of the present invention to provide a filter assembly of a washing machine, which can be manufactured with low cost and ease as well as has a simple structure facilitating to be cleaned.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a filter assembly of a washing machine including a filter case comprising inlet and outlet on a circumference thereof and an opening therein to make the inlet and outlet communicate with each other and a filter provided in the filter case, the filter having a plate disposed in front of the opening to prevent a heavy particle from passing through the opening wherein the heavy particle is gathered in a central area by a centrifugal force when water flowing in the filter case via the inlet whirls to pass through the opening.

Preferably, the filter case is cylindrical, the inlet is provided on an outer surface of the filter case along a tangent direction, and the plate and the opening are circular.

Preferably, the filter case includes a tube having the inlet and outlet on a circumference thereof, a partition wall provided in the tube to partition an internal space of the tube into first and second chambers communicating with the inlet and outlet, respectively, and the opening perforating the partition wall.

More preferably, the inlet is provided on an outer surface of the tube along a tangent direction, an impeller is provided in the second chamber to forcibly circulate the water by being rotated by a motor, and the filter is provided in the first chamber.

Preferably, the filter includes a cap fitted to the filter case to be fixed thereto, a shaft extending from the cap toward the opening, and the plate provided at an end of the shaft to be disposed in front of the opening with a predetermined gap.

More preferably, the shaft is disposed along a central axis of the filter case, the filter is built in one body, a size of the plate is larger than that of the opening, an edge of the plate is overlapped with a rim of the opening, and the filter further includes a handle extending from the cap to facilitate to be grabbed.

In another aspect of the present invention, there is provided a filter assembly of a washing machine including a filter case comprising a tube having inlet and outlet on a circumference, a partition wall provided in the tube to partition an internal space of the tube into first and second chambers communicating with the inlet and outlet, respectively, and the opening perforating the partition wall and a filter comprising a cap fitted to the filter case to be fixed thereto, a shaft extending from the cap toward the opening, and a plate provided at an end of the shaft to be disposed in front of the opening with a predetermined gap to prevent a heavy particle from passing through the opening wherein the heavy particle is gathered in a central area by a centrifugal force when water flowing in the first chamber via the inlet whirls to pass through the opening.

Preferably, the tube is cylindrical and the inlet is provided on an outer surface of the tube along a tangent direction, the plate and the opening are circular, an impeller is provided in the second chamber to forcibly circulate the water by being rotated by a motor, the shaft is disposed along a central axis of the tube, the filter is built in one body, a size of the plate is larger than that of the opening, an edge of the plate is overlapped with a rim of the opening, the filter further includes a handle extending from the cap to facilitate to be grabbed.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
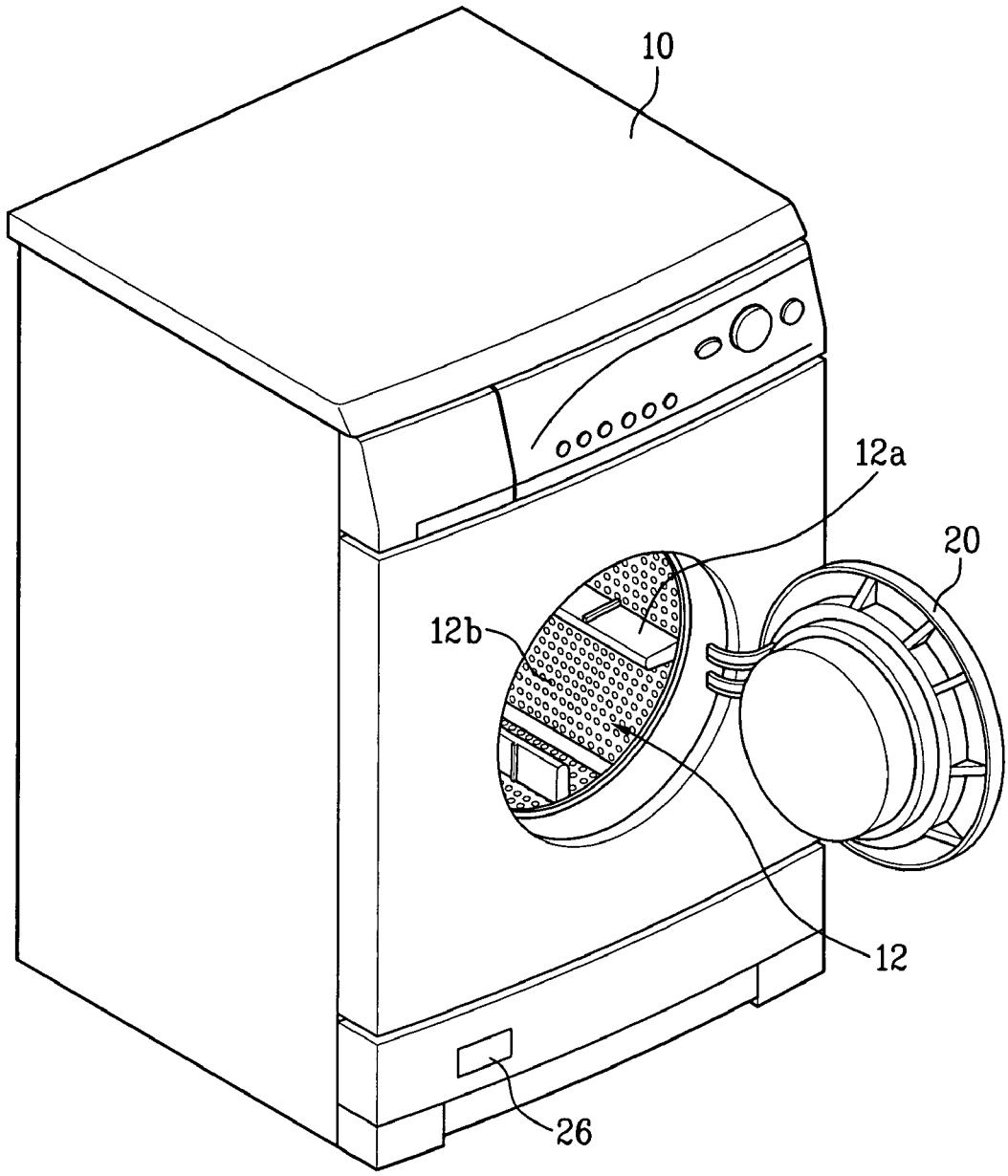
FIG. 1 is a perspective view of a washing machine including a filter assembly according to the present invention.

FIG. 1 is a perspective view of a washing machine including a filter assembly according to the present invention, in which a drum type washing machine is illustrated. Yet, the present invention can be equivalently implemented for the agitator and pulsator type washing machines as well as the drum type.

Referring to FIG. 1, a drum 12 is provided inside a cabinet 10. A plurality of tumbling ribs 12*a* are provided on an inner circumference of the drum 12 and a plurality of perforated holes 12*b* are provided on an outer surface of the drum 12. The rum 12 is rotated by a driver (not shown in the drawing).

A tub (not shown in the drawing) is provided in the cabinet 10 to enclose the drum 12. Hence, water supplied in the tub communicates with the drum 12 through the perforated holes 12*b*. Meanwhile, a door 20 is provided on a front side of the cabinet 10 to put laundry in or out of the drum 12.

A filter cover 26 is provided on one side of the cabinet 10. A filter assembly (not shown in the drawing) and a drain pump (not shown in the drawing) are provided inside the cabinet 10 behind the filter cover 26. The drain pump forcibly discharges washing water outside after completion of a washing step. And, the filter assembly removes particles contained in the washing water, which is being drained, to prevent the drain pimp from being out of order or making noise.

A filter assembly loaded in a washing machine according to the present invention can be implemented in various ways and is explained in detail by referring to the attached drawings as follows.

Figure 2:
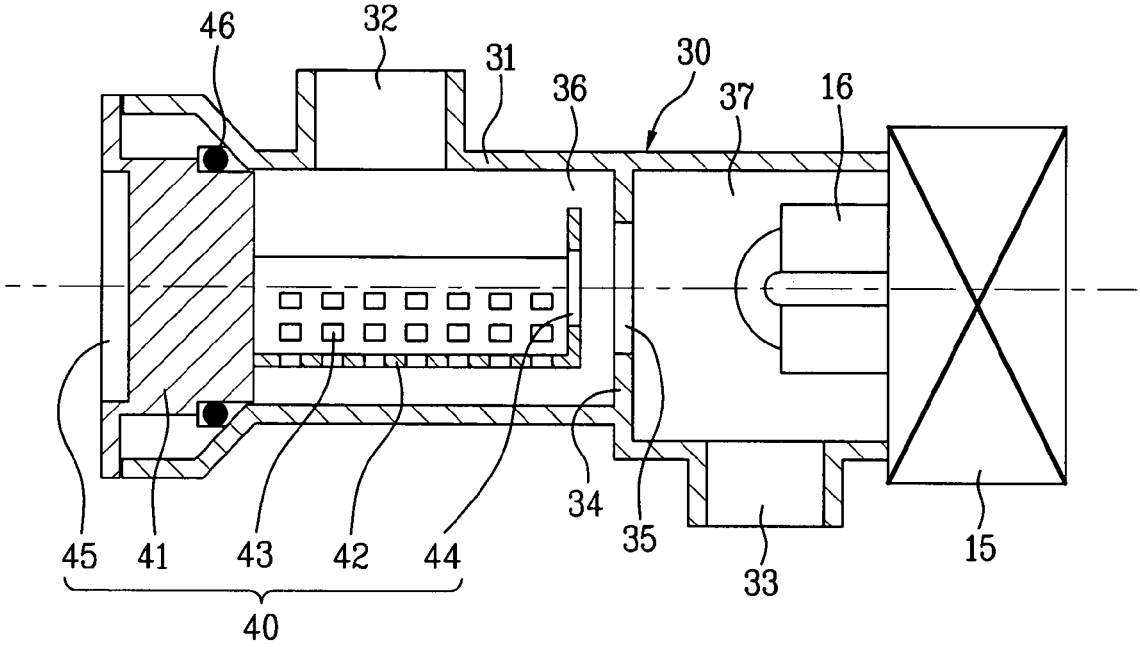
FIG. 2 is a cross-sectional view of a filter assembly according to a first embodiment of the present invention.
Figure 3:
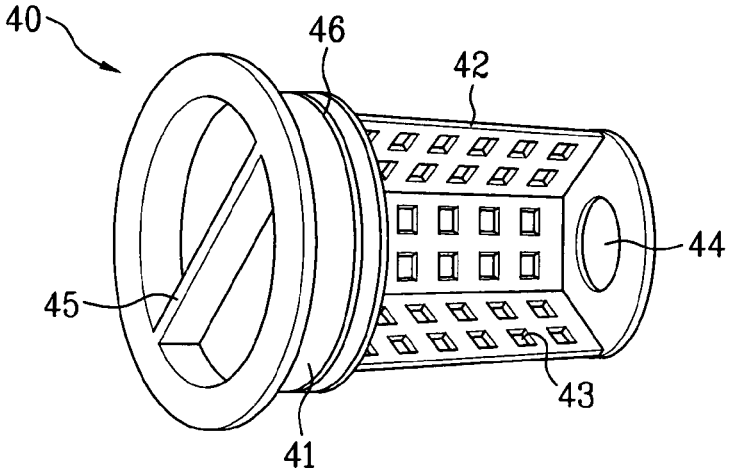
FIG. 3 is a perspective view of the filter assembly in FIG. 2.
Figure 4:
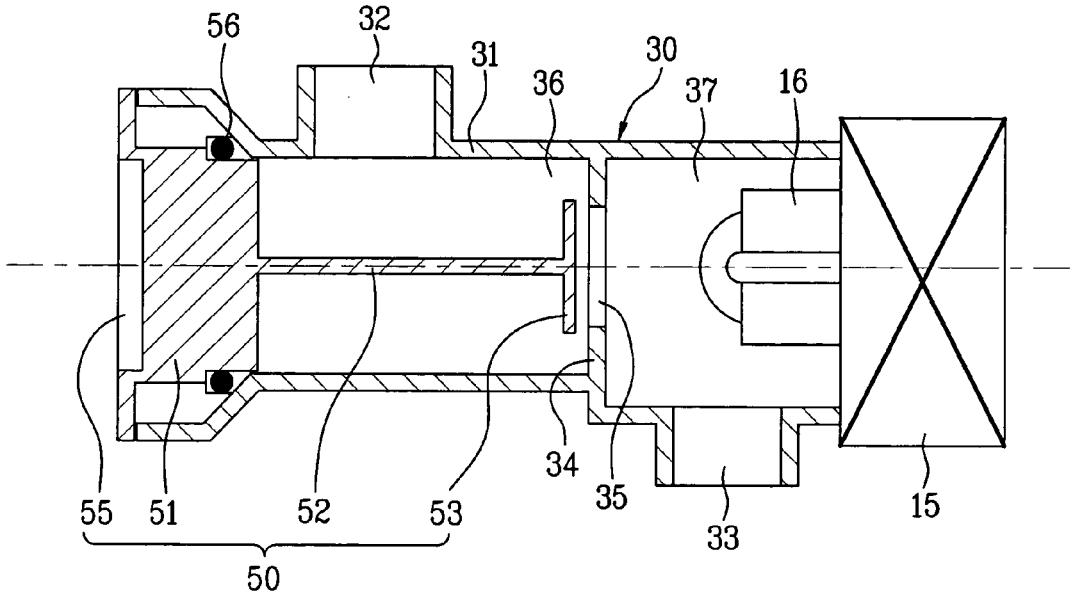
FIG. 4 is a cross-sectional view of a filter assembly according to a second embodiment of the present invention.
Figure 5:
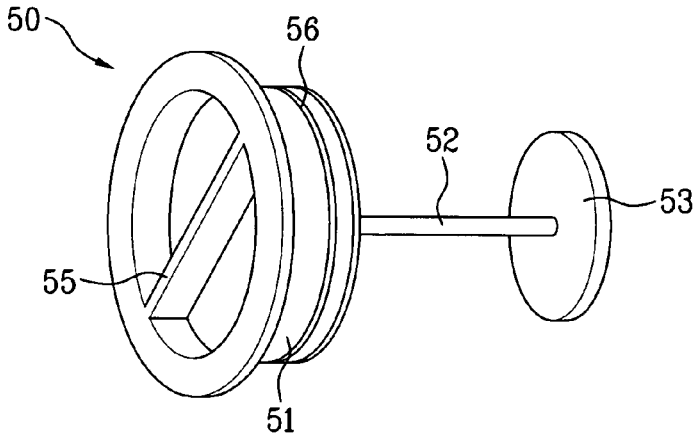
FIG. 5 is a perspective view of the filter assembly in FIG. 4.

FIG. 2 is a cross-sectional view of a filter assembly according to a first embodiment of the present invention, FIG. 3 is a perspective view of the filter assembly in FIG. 2, FIG. 4 is a cross-sectional view of a filter assembly according to a second embodiment of the present invention, and FIG. 5 is a perspective view of the filter assembly in FIG. 4.

Referring to FIG. 2, a filter assembly according to a first embodiment of the present invention includes a filter case 30 and a filter 40.

The filter case 30 includes a tube 31, a partition wall 34, and an opening 35.

Both ends of the tube 31 are open, and an inlet 32 and an outlet 33 are provided on an outer circumference of the tube 31. The inlet 32 communicates with a tub (not shown in the drawing). On draining, water in the tub and the drum 32 flows into the tube 31 via the inlet 32.

The partition wall 34 is provided in the tube 32 to partition an internal space of the tube 31 into a first chamber 36 and a second chamber 37. The first chamber 36 communicates with the inlet 32 and the second chamber 37 communicates with the outlet 33. Of course, the both open ends of the tube 31, as shown in FIG. 2, communicate with the first and second chambers 36 and 37, respectively.

The opening 35 is provided to perforate the partition wall 34. The water flowing into the first chamber 36 via the inlet 32 passes through the opening 35 and the second chamber 37 to be discharges outside via the outlet 33.

And, a drain pump is mounted on one of two ends of the filter case 30. The drain pump includes a motor 15 and an impeller 16. The impeller 16 rotated by the motor 15 is mounted to be disposed in the second chamber 37.

Meanwhile, the filter 40, as shown in FIG. 2 and FIG. 3, includes a cap 41, a body 42, and a hole 44.

The cap 41 is fitted to the end of the tube 31 next to the first chamber 36 to be coupled with the tube 31. In this case, a handle 45 extends from the cap 41 to facilitate a user to grab the cap 41 with ease. And, at least one seal 46 is provided on an outer circumference of the cap 41. The seal 46 prevents water from leaking when the cap 41 is coupled with the tube 31.

The body 42 extends from the cap 41 toward the opening 35. For instance, the body 42 has a shape of a multiply-bent plate. And, a multitude of apertures 43 perforate the body 42.

And, the hole 44, as shown in FIG. 2 and FIG. 3, is provided on a side of the body 42 to confront the opening 35 of the filter case 30. Hence, water flowing into the first chamber 36 via the inlet 32 passes through the apertures 43 and hole 44 of the body 42, the opening 35 of the filter case 30, and the second chamber 37 to be discharged outside via the outlet 33.

The above-constructed filter assembly according to the first embodiment of the present invention removes particles such as lint and the like involved in washing water in a following manner.

First of all, once the motor 15 is actuated to rotate the impeller 16, the water, which is contaminated or dirty, in the tube (not shown in the drawing) and the drum 12 flows into the first chamber 36 via the inlet 32. The water in the first chamber 36 then passes through the apertures 43 of the body 42 so that particles including lint and the like involved in the water fails to pass through the apertures 43 to be filtered. In this case, the particles failing to pass through the apertures 43 remain attached to the body 42.

The filtered water having passed through the apertures 43 of the body 42 then flows into the second chamber 37 via the hole 44 of the body 42 and the opening 35 of the filter case 30. The water in the second chamber 37 is forced to move to the outlet 33 by the impeller 16 to be discharged outside.

The filter assembly according to the first embodiment of the present invention filters the particles in the drain water using the filter 40, thereby enabling to reduce operation failure or breakdown of the drain pump.

Meanwhile, in the filter assembly according to the first embodiment of the present invention, a considerable amount of the particles in the water flows in the second chamber 37 via the apertures and hole 43 and 44. Hence, it is difficult to completely prevent the failure of the drain pump. Besides, the filter 40 has a complicated structure and shape to be difficult to clean.

Moreover, the body 42 of the filter assembly according to the first embodiment of the present invention has such a complicated shape. Hence, the cap 41 and body 42 are separately fabricated into two pieces, and the cap 41 is coupled to the body 42 during use. A plurality of molds are required to manufacture the filter, requiring a complicated manufacturing process, thus decreasing productivity and increasing product cost.

In order to overcome such a disadvantage of the first embodiment, the present invention provides a second embodiment that is shown in FIG. 4 and FIG. 5.

FIG. 4 is a cross-sectional view of a filter assembly according to a second embodiment of the present invention and FIG. 5 is a perspective view of the filter assembly in FIG. 4, in which like elements are indicated using the same or similar reference designations where possible.

Referring to FIG. 4 and FIG. 5, a filter assembly according to a second embodiment of the present invention includes a filter case 30 and a filter 50. A structure of the filter case 30 is similar or equivalent to that of the first embodiment of the present invention, thereby being skipped in the following. And, a characterized structure of the filter case 30 of the filter assembly according to the second embodiment of the present invention is explained as follows.

In the filter assembly according to the second embodiment of the present invention, a technical background of removing particles is similar to that of a cyclone type vacuum cleaner which filters dust and particles heavier than air using a centrifugal force. Such a principle is explained as follows.

First of all, while water whirled in the first chamber 36 moves toward the second chamber 37, particles heavier than the water are gathered around a center of whirl hut the water is pushed toward an inner surface of the tube 31. In this case, the particles gathered around the center of the whirl just remain in the first chamber 36 due to a plate 53 leaving a predetermined interval from the opening 35 but the water flows in the second chamber 37 only. Such a principle is similar to a centrifuge or a cyclone type vacuum cleaner which separates a heavy material from a light material using a centrifugal force.

As explained in the above-description, the filter assembly according to the second embodiment of the present invention separates particles using a centrifugal force. The water flowing in the first chamber 36 via the inlet 32 turns around along the inner surface of the first chamber 36 to whirl. Hence, the tube 31, and more particularly, the first chamber 36 side is preferably formed cylindrical. Furthermore, the inlet 32 is preferably formed on an outer circumference of the tube 31 along a tangential direction thereof. With such a structure, the water having passed through the inlet 32 quickly moves along an inner circumference of the tube 31, i.e. inner circumference of the first chamber 36, thereby enabling to form the whirl in the first chamber 36 with ease.

Meanwhile, in the filter assembly according to the second embodiment of the present invention, the inlet 32 is preferably provided on an outer circumference of the tube 31 and the outlet 33 is preferably provided beneath the outer circumference of the tube 31. This facilitates to make the water flow in via the inlet 32 or to discharge the water outside via the outlet 33. And, in the filter assembly according to the second embodiment of the present invention, a drain pump including a motor 15 and an impeller 16 is coupled with a side of the second chamber 37 of the filter case 30 like the first embodiment of the present invention.

And, the filter 50, as shown in FIG. 4 and FIG. 5, includes a cap 51, a rod or shaft 52, and a plate 53.

The cap 51, as shown in FIG. 5, is fitted into the tube 31 of the filter case 30 to be contacted with the first chamber 36. In this case, a handle 55, as shown in FIG. 5, may extend from one side of the cap 51 to facilitate a user to grab the cap 51 for fitting to the tube 31. And, at least one seal 56, as shown in FIG. 4 and FIG. 5, can be provided on an outer circumference of the cap 51. When the cap 51 is fitted into the tube 31 to be fixed, the seal 56 prevents the water in the first chamber 36 from leaking outside.

The shaft 52 extends from the cap 51 toward the opening 35. Preferably, such a shaft 52, as shown in FIG. 4, is disposed along a central axis of the tube 31 of the filter case 30.

And, the plate 53, as shown in FIG. 5, is provided at one end of the shaft 52. The plate 53, as shown in FIG. 4, is disposed parallel with the partition wall 34 to leave a predetermined gap from the opening 35. The water in the first chamber 36 flows into the opening 35 via such a gap.

In the filter assembly according to the second embodiment of the present invention, a size, e.g., diameter, of the plate 53 is preferably larger than that of the opening 35. Moreover, an edge of the plate 53, as shown in FIG. 4, is preferably overlapped with a rim of the opening 35. Namely, in view point from the cap side toward the plate 53, the opening 35 is blocked by the plate 53 so as not to be seen. This effectively prevents particles, which move toward the opening 35 in a direction of the shaft 52 in the first chamber 36 and are then blocked by the plate 53, from flowing into the opening 35.

Meanwhile, the filter 50 of the filter assembly, as shown in FIG. 4 and FIG. 5, has a very simple shape. Besides, the filter 50, i.e., the cap, shaft, plate, and handle 51, 52, 53, and 55, can be built in one body. Hence, the filter 50 can be fabricated using a single mold, thereby reducing its product cost.

Operation of the filter assembly according to the second embodiment of the present invention is explained as follows.

First of all, one drain is executed after completion of washing, the motor 15 is actuated to rotate the impeller 16. Water having particles in the drum 12 and tub (not shown in the drawing) then starts to flow in the first chamber 36 via the inlet 32. In this case, the water turns centering around the shaft 52 to form a whirl.

The whirling water moves toward the opening 35. In this case, a centrifugal force drives the particle-free water to move in a circumferential direction of the whirl, and drives the particles to move in a central direction of the whirl. Hence, the plate 53 prevents the particles located in the central area of the whirl from flowing through the opening 35 so that the particles remain in the first chamber 36, whereas the water in the circumferential area of the whirl flows toward the opening 35 via the gap. If the plate and opening 53 and 35 are formed circular, formation of the whirl may be accelerated.

In the mean time, a small amount of the particles remaining in the circumferential area of the whirl fails to pass the gap between the plate and opening 53 and 35 but is filtered. This is because most of the particles are lint that is unable to pass through the narrow gap with ease. Hence, the water of which particles are filtered comes into flowing in the second chamber 37.

Besides, the particles remaining in the first chamber 36 is wound around the shaft 52. Furthermore, other particles moving in the central direction of the whirl keep being entangled with the shaft-wound particles to be easily separated from the water. Moreover, the particles failing to pas the narrow gap are attached to the edge of the plate 53.

In the filter assembly according to the second embodiment of the present invention, which removes the particles involved in the water drained by the above-explained process, it is facilitated to clean the filter 50. In order to clean the filter 50, a user opens the filter cover 26 in FIG. 1 and then grabs the handle 55 provided in the cap 51 of the filter 50 to pull the filter 50 out of the filter case 30. The filter 50, as shown in FIG. 5, is finally pulled outside. Once the filter 50 is pulled out, the user removes the particles attached to the shaft 52 and the edge of the plate 53. Since the structure of the filter 50 is very simple, it is easier to remove the particles than is in the first embodiment of the present invention. Once the particles are completely removed from the filter 50, the filter 50 is assembled in a reverse order of the above-explained step and the filter cover 26 is then closed.

The filter assembly according to the present invention has the following advantages or effects.

First of all, the particles involved in the water are removed on draining, whereby operational failure, breakdown, and noise can be prevented.

Secondly, the filter of the filter assembly according to the second embodiment of the present invention has such a simple structure that can be cleaned with ease.

Finally, the filter of the filter assembly according to the second embodiment of the present invention has such a simple structure that can reduce product cost and improve productivity.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A filter assembly for a washing machine, comprising:

a filter case, comprising:

a body with an interior space formed therein;

an inlet and an outlet each positioned on an outer peripheral portion of the body; and a passage provided within the interior space of the body and configured to provide for communication between the inlet and outlet; and a filter provided in the filter case, the filter comprising a rod with a solid walled plate disposed at one end thereof and in opposition to the passage so as to prevent a particle from passing through the passage, wherein the filter is configured to gather particles in a central portion thereof in response to a centrifugal force generated when fluid flows into the filter case through the inlet and generates a circular flow within the body as it whirls towards the passage.

2. The filter assembly of claim 1, wherein the filter case is substantially cylindrical.

3. The filter assembly of claim 2, wherein the inlet is provided on an outer surface of the filter case and is oriented in a tangential direction with respect to the filter case.

4. The filter assembly of claim 1, wherein the plate and the passage are substantially circular.

5. The filter assembly of claim 1, wherein the filter case further comprises a partition wall provided in the body and configured to partition the interior space formed within the body into a first chamber in communication with the inlet and a second chamber in communication with the oulet, wherein the passage extends through the partition wall.

6. The filter assembly of claim 5, wherein the body is substantially tubular, and wherein the inlet is provided on an outer surface of the body and is oriented in a tangential direction with respect to the body.

7. The filter assembly of claim 5, further comprising an impeller provided in the second chamber and a motor configured to rotate the impeller, wherein the impeller is configured to forcibly circulate fluid within the filter assembly.

8. The filter assembly of claim 5, wherein the filter is provided in the first chamber.

9. The filter assembly of claim 1, wherein the filter further comprises a cap configured to be fitted to the filter case , wherein the rod extends from the cap toward the passage, and wherein the plate is provided at an end of the rod opposite the cap so as to face the passage, with a predetermined gap formed between the plate and the passage.

10. The filter assembly of claim 9, wherein the rod is disposed along a central axis of the filter case.

11. The filter assembly of claim 9, wherein the filter comprises a single body.

12. The filter assembly of claim 9, wherein a size of the plate is greater than a corresponding size of the passage.

13. The filter assembly of claim 9, wherein an edge of the plate overlaps a corresponding rim of the passage.

14. The filter assembly of claim 9, wherein the filter further comprises a handle extending from the cap.

15. The filter assembly of claim 9, wherein the rod extends continuously between the cap and the plate in a longitudinal direction of the filter case.

16. The filter assembly of claim 5, wherein the tangential orientation of the inlet causes fluid introduced into the first chamber to flow along an inner circumference of the first chamber so as to generate a circular flow within the first chamber and draw particles in the fluid towards the central portion of the filter.

17. The filter assembly of claim 7, wherein the impeller is configured to draw water in the first chamber through the passage into the second chamber and out through the outlet.

18. The filter assembly of claim 9, wherein the predetermined gap is sized such that it allows wash water to pass therethrough and into the second chamber via the passage, while retaining particles greater than a predetermined size within the first chamber.

19. The filter assembly of claim 18, wherein the particles greater than a predetermined size are retained by at least one of the rod and the plate as the fluid whirls toward the passage.

20. The filter assembly of claim 14, wherein, when the filter assembly is installed in a washing machine, the handle is accessible from an exterior of the washing machine.

21. A washing machine comprising the filter assembly of claim 1.

22. The filter assembly of claim 1, wherein the plate comprises a contiguous surface such that neither particles nor water flow therethrough.

23. The filter assembly of claim 1, wherein the plate is disposed substantially perpendicular to the rod.

24. The filter assembly of claim 5, wherein the plate and the partition wall are formed separate from each other, with the plate confronting an opening in the partition wall which forms the passage such that a gap is formed between the plate and the partition wall.

25. A filter assembly for a washing machine, comprising:

a filter case, comprising:

a tube having an inlet and an outlet provided on a circumferential portion of the tube;

a partition wall provided in the tube and configured to partition an internal space of the tube into a first chamber in communication with the inlet, and a second chamber in communication with the outlet; and an opening extending through the partition wall; and a filter, comprising:

a cap fitted to the filter case;

a rod extending from the cap toward the opening; and a plate provided at an end of the rod and positioned facing the opening in the partition wall with a predetermined gap formed between the plate and the partition wall, wherein the plate is configured to prevent particles from passing through the opening, and wherein the filter is configured to gather particles in a central area thereof in response to a centrifugal force generated when fluid whirls through the first chamber towards the opening.

26. The filter assembly of claim 25, wherein the tube is substantially cylindrical and the inlet is provided on an outer surface of the tube and is oriented in a tangential direction with respect to the tube.

27. The filter assembly of claim 25, wherein the plate and the opening are substantially circular.

28. The filter assembly of claim 25, further comprising an impeller provided in the second chamber and a motor configured to drive the impeller, wherein the impeller is configured to forcibly circulate fluid within the filter assembly.

29. The filter assembly of claim 25, wherein the rod is disposed along a central axis of the tube.

30. The filter assembly of claim 25, wherein the filter comprises a single body.

31. The filter assembly of claim 25, wherein a size of the plate is greater than a corresponding size of the opening.

32. The filter assembly of claim 25, wherein an edge of the plate overlaps a corresponding rim of the opening.

33. The filter assembly of claim 25, wherein the filter further comprises a handle extending from the cap.

34. A filter assembly of claim 25, wherein the rod extends continuously from the cap to the plate in a longitudinal direction of the tube.

35. A washing machine comprising the filter assembly of claim 25.

36. The filter assembly of claim 25, wherein the plate comprises a solid walled surface.

37. The filter assembly of claim 25, wherein the plate is disposed substantially perpendicular to the rod.

38. The filter assembly of claim 25, wherein the plate and the partition wall are formed separate from each other, with the plate confronting an opening in the partition wall which forms the passage such that a gap is formed between the plate and the partition wall.

39. A filter assembly for a washing machine, comprising:

a filter case, comprising:

a body with an interior space formed therein;

an inlet and an outlet each positioned on an outer peripheral portion of the body; and a passage provided within the interior space of the body and configured to provide for communication between the inlet and outlet; and a filter provided in the filter case, the filter comprising a rod and a solid walled plate disposed in opposition to the passage so as to prevent a particle from passing through the passage, wherein the rod is configured to gather particles thereof in response to a centrifugal force generated when fluid flows into the filter case through the inlet and generates a circular flow within the body as it whirls towards the passage.

40. The filter of claim 39, wherein the filter case further comprises a partition wall provided in the body and configured to partition the interior space formed within the body into a first chamber in communication with the inlet and a second chamber in communication with the outlet, wherein the passage extends through the partition wall.

41. The filter of claim 40, wherein the filter further comprises a cap configured to be fitted to the filter case, wherein the rod extends from the cap toward the passage, and the plate is provided at an end of the rod opposite the cap so as to face the passage, with a predetermined gap formed between the plate and the passage.

42. The filter of claim 41, wherein the filter case is substantially cylindrical and the plate and the passage are substantially circular, and wherein the inlet is provided on an outer surface of the filter case and is oriented in a tangential direction with respect to the filter case.

43. The filter of claim 42, wherein the tangential orientation of the inlet causes fluid introduced into the first chamber to flow along an inner circumference of the first chamber so as to generate a circular flow within the first chamber and draw particles in the fluid towards the central portion of the filter.

44. The filter of claim 41, wherein a size of the plate is greater than a corresponding size of the passage such that an edge of the plate overlaps a corresponding rim of the passage, and wherein the predetermined gap is sized such that it allows wash water to pass therethrough and into the second chamber via the passage while retaining particles greater than a predetermined size within the first chamber.

45. The filter of claim 39, wherein the plate comprises a contiguous surface such that neither particles nor water flow therethrough.

46. The filter of claim 40, wherein the plate and the partition wall are formed separate from each other, with the plate confronting an opening in the partition wall which forms the passage such that a gap is formed between the plate and the partition wall.

47. The filter of claim 41, wherein the plate is disposed substantially perpendicular to the rod.

* * * * *